US011167946B2

(12) United States Patent
Nir et al.

(10) Patent No.: US 11,167,946 B2
(45) Date of Patent: Nov. 9, 2021

(54) MEDIA ALIGNMENT

(71) Applicant: HP INDIGO B.V., Amstelveen (NL)

(72) Inventors: Jonathan Nir, Ness Ziona (IL); Haim Touitou, Ness Ziona (IL); David Mazar, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 95 days.

(21) Appl. No.: 16/603,791

(22) PCT Filed: Apr. 21, 2017

(86) PCT No.: PCT/EP2017/059551

§ 371 (c)(1),
(2) Date: Oct. 8, 2019

(87) PCT Pub. No.: WO2018/192671

PCT Pub. Date: Oct. 25, 2018

(65) Prior Publication Data

US 2020/0247632 A1 Aug. 6, 2020

(51) Int. Cl.

| | |
|---|---|
| ***B65H 9/00*** | (2006.01) |
| ***B65H 5/06*** | (2006.01) |
| ***B65H 5/10*** | (2006.01) |
| ***B65H 5/38*** | (2006.01) |
| ***B65H 9/06*** | (2006.01) |

(52) U.S. Cl.

CPC ..... *B65H 9/004* (2013.01); *B65H 5/06* (2013.01); *B65H 5/10* (2013.01); *B65H 5/38* (2013.01);

(Continued)

(58) Field of Classification Search

CPC . B65H 5/06; B65H 5/062; B65H 5/08; B65H 5/10; B65H 5/38; B65H 9/004;

(Continued)

(56) References Cited

U.S. PATENT DOCUMENTS

| | | | |
|---|---|---|---|
| 5,965,862 | A | 10/1999 | Momose |
| 6,974,128 | B2 | 12/2005 | Quesnel |

(Continued)

FOREIGN PATENT DOCUMENTS

| | | |
|---|---|---|
| EP | 2845824 | 3/2015 |
| GB | 1406346 | 9/1975 |

(Continued)

OTHER PUBLICATIONS

Document Scanner KV-S4085CW / S4085CL / S4065CW / S4065CL—Features, <http://panasonic.net/pcc/products/scanner/kv-s4085_4065/features.html>.

*Primary Examiner* — Prasad V Gokhale

(74) *Attorney, Agent, or Firm* — Dierker & Kavanaugh PC

(57) ABSTRACT

In one example, a sheet media alignment system includes: a guide (12) defining a curved media path (14) that extends from an upstream part of the guide to a downstream part of the guide; a movable blocker (16, 56) to block the curved media path (14) at the downstream part of the guide, the blocker movable into and out of a blocking position in which the blocker is spaced from the downstream part of the guide a first distance; and a driver (24, 58) upstream from the curved media path to drive a media sheet into the guide along the curved media path and into the blocker. The driver is spaced from the upstream part of the guide a second distance greater than the first distance such that a media sheet driven into the blocker will buckle between the driver and the guide before it will buckle between the guide and the blocker.

15 Claims, 5 Drawing Sheets

(52) U.S. Cl.
CPC ..... *B65H 9/06* (2013.01); *B65H 2404/6111* (2013.01); *B65H 2404/722* (2013.01); *B65H 2404/7231* (2013.01); *B65H 2404/7431* (2013.01)

(58) Field of Classification Search
CPC .... B65H 9/006; B65H 9/06; B65H 2404/611; B65H 2404/6111; B65H 2404/722; B65H 2404/723; B65H 2404/7231; B65H 2404/725; B65H 2404/7431
See application file for complete search history.

(56) References Cited

U.S. PATENT DOCUMENTS

| | | | | |
|---|---|---|---|---|
| 7,938,399 | B2 | 5/2011 | Kawaguchi et al. | |
| 8,036,588 | B2 | 10/2011 | Ishida et al. | |
| 9,045,296 | B2 | 6/2015 | Matsumoto | |
| 2002/0076250 | A1* | 6/2002 | Johnson | B65H 9/06 400/630 |
| 2004/0028438 | A1* | 2/2004 | Shin | B65H 9/106 399/388 |
| 2012/0092431 | A1 | 4/2012 | Hara et al. | |
| 2013/0256982 | A1 | 10/2013 | Kawanago et al. | |
| 2015/0071692 | A1* | 3/2015 | Maruta | B65H 7/02 399/361 |
| 2016/0154362 | A1 | 6/2016 | Yamakawa et al. | |

FOREIGN PATENT DOCUMENTS

| | | | | |
|---|---|---|---|---|
| JP | 58100047 | A * | 6/1983 | B65H 9/004 |
| JP | 60197548 | A * | 10/1985 | B65H 5/36 |
| JP | 2001010747 | | 1/2001 | |

* cited by examiner

MEDIA ALIGNMENT

BACKGROUND

Liquid electrophotographic (LEP) printing uses a special kind of ink to form images on paper and other print media. An LEP printing process involves placing an electrostatic pattern of the desired printed image on a photoconductor and developing the image by presenting a thin layer of LEP ink to the charged photoconductor. Charged particles in the ink adhere to the pattern of the desired image on the photoconductor. The ink image is transferred from the photoconductor to an intermediate transfer member and then to the print media as the print media passes through a nip between an intermediate transfer member and an impression cylinder.

DRAWINGS

Figure 1:
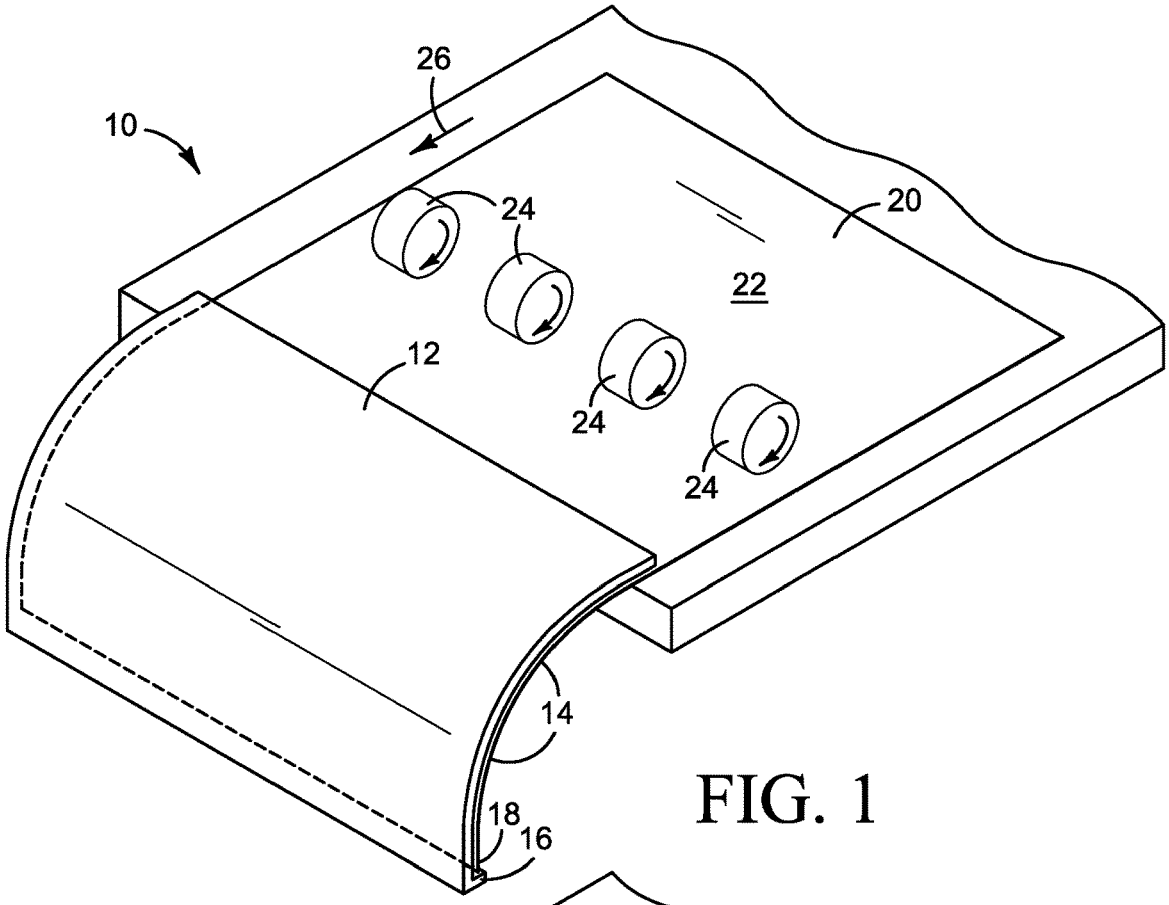
Figure 2:
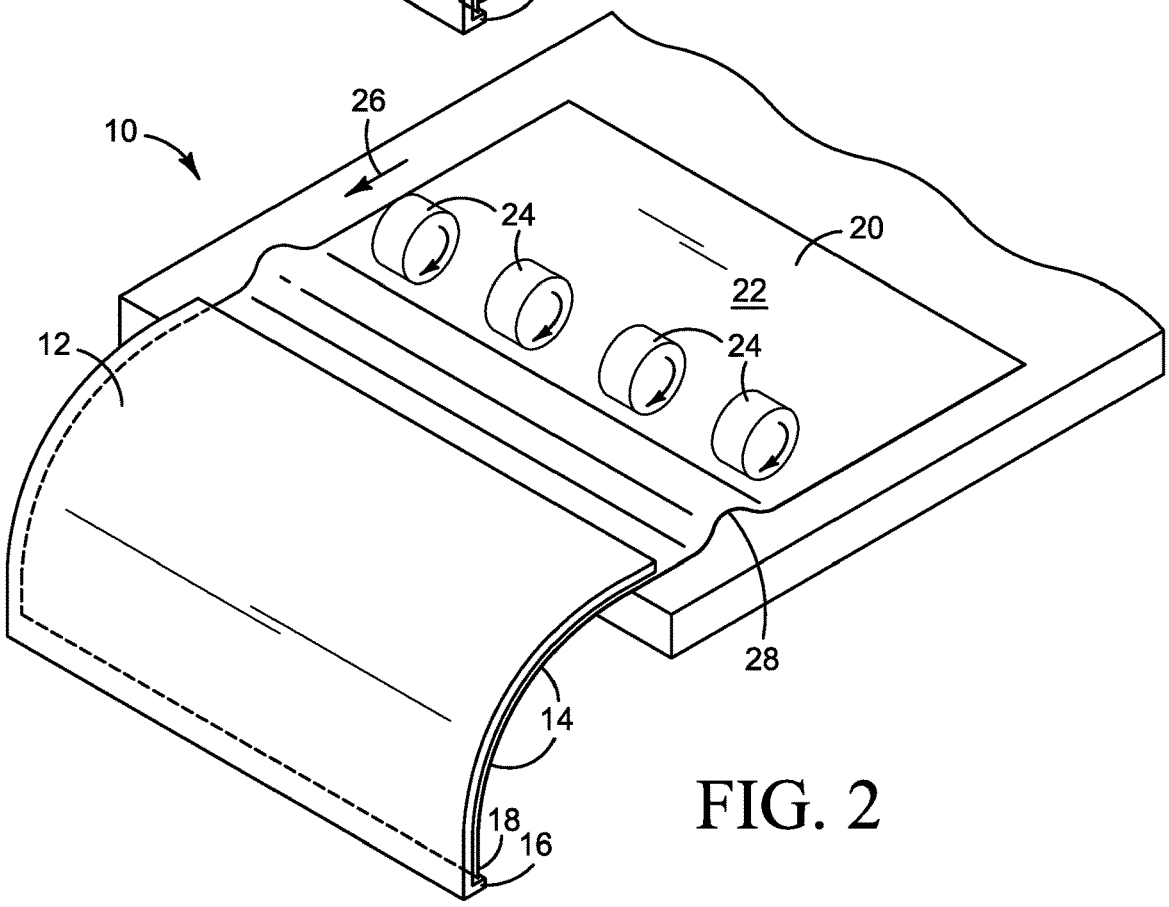

FIGS. 1 and 2 are perspective views illustrating one example of a new sheet media alignment system.

Figure 3:
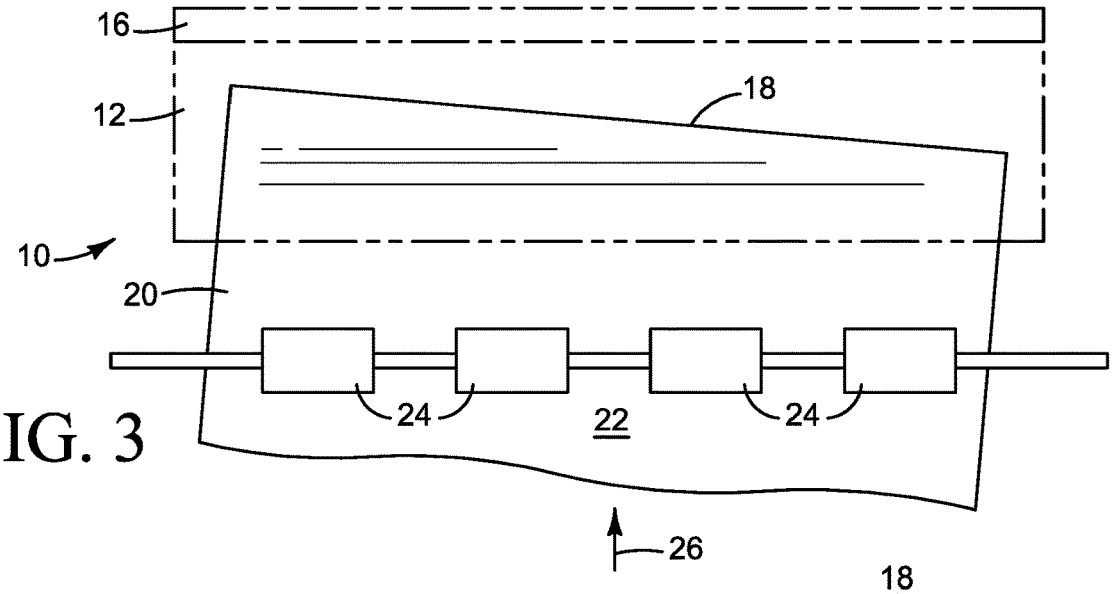
Figure 4:
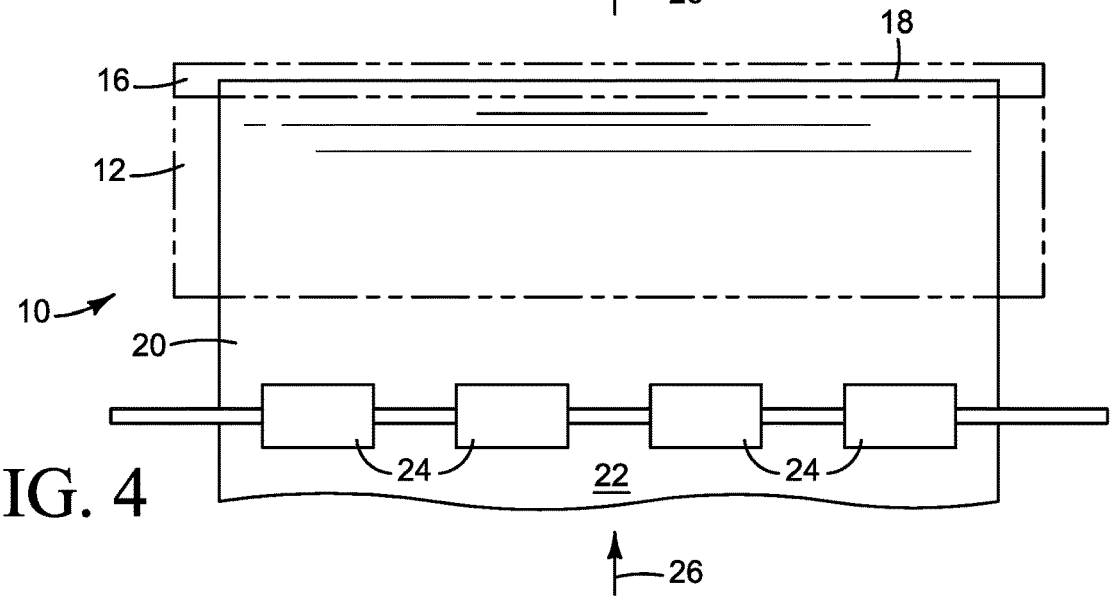
Figure 5:
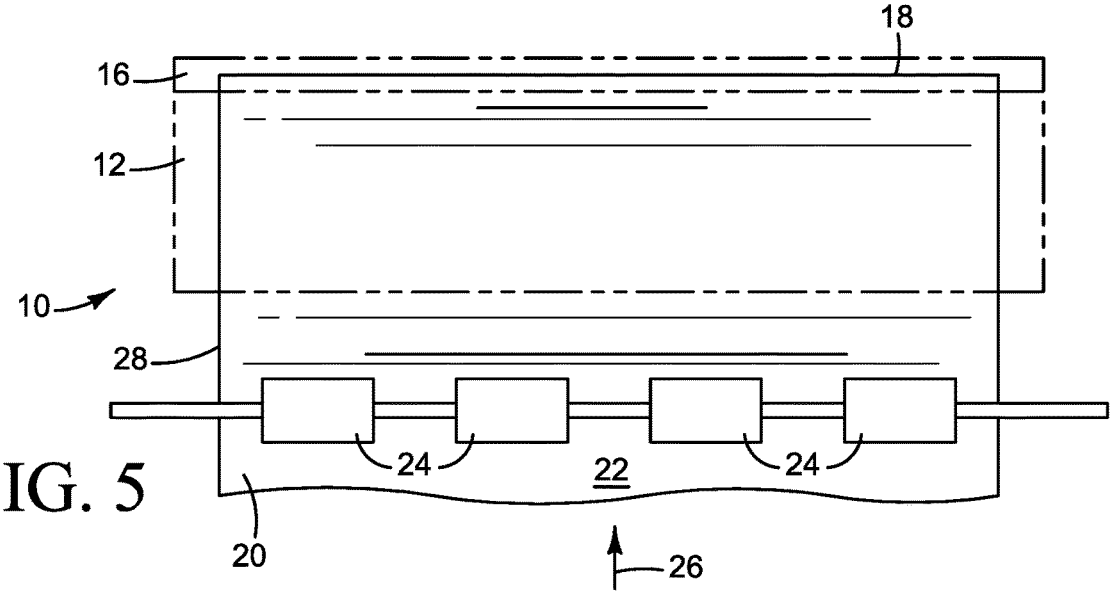

FIGS. 3-5 present a sequence of plan views showing an example alignment operation using the alignment system shown in FIGS. 1 and 2.

Figure 6:
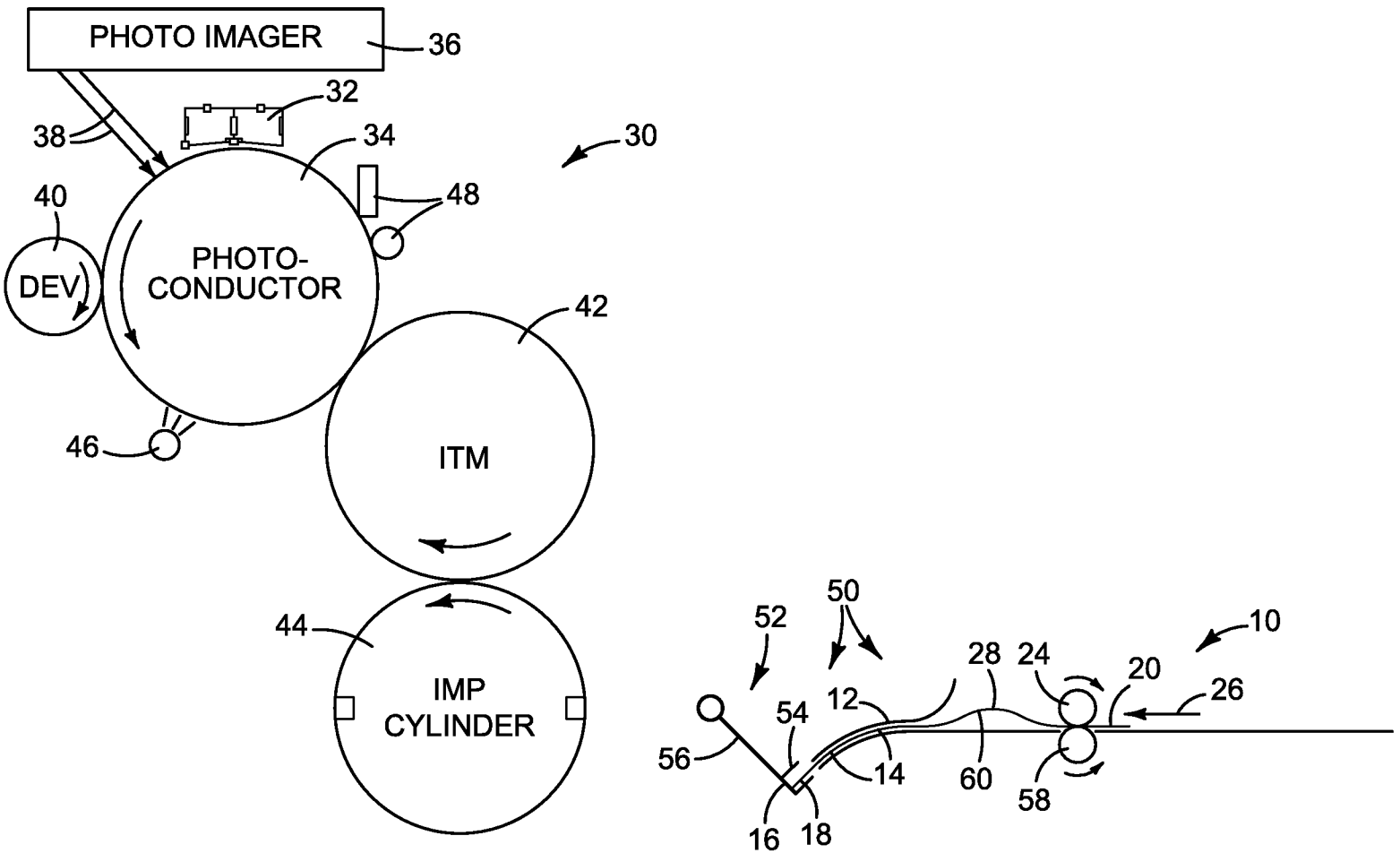

FIG. 6 is a diagrammatic view illustrating an example printer implementation for a sheet media alignment system such as the one shown in FIGS. 1 and 2.

FIGS. 7-11 present a sequence of diagrammatic views showing the operation of the example alignment system shown in FIG. 6.

The same part numbers designate the same or similar parts throughout the figures. The figures are not necessarily to scale.

DESCRIPTION

In LEP printing, as in many other printing processes, it is desirable to accurately align the paper or other print media to the printing unit to produce good quality images. Sheet media may be aligned for printing by driving the leading edge of the sheet into a blocker until the sheet buckles. The blocker is oriented across the media path in the desired alignment. Any misalignment across the leading edge of the sheet, commonly referred to as "skew", is removed as the sheet is driven into the blocker. That is to say, the sheet is "deskewed" by driving it into the blocker. Buckling signals that the sheet has engaged the blocker across the full width of the leading edge for proper alignment. The blocker is them removed from the media path so the sheet can proceed to the printing unit.

Buckle deskew can damage the print media. It has been discovered that shaping the print media leading into the blocker helps reduce the risk of damage during deskew. In one example, a sheet media alignment system includes a guide defining a curved media path and a blocker to block the curved media path at the downstream part of the guide. A drive roller upstream from the curved media path drives a media sheet into the guide along the curved media path and into the blocker. The drive roller is spaced from the upstream part of the guide a distance sufficient to enable the sheet to buckle between the drive roller and the guide as the sheet is driven into the blocker. The leading part of the sheet, which conforms to the curve of the guide, is better able to absorb the shock of hitting the blocker and withstand the driving forces applied until the sheet buckles. Although the exact mechanism for increased toughness is not certain, it is believed the curved shape and the constraints of the guide together stiffen the sheet laterally across the media path to better resist wrinkling and increase the resilience of the sheet lengthwise along the media path to better absorb the shock of impact. The increased toughness of the shaped sheet lowers the risk of damage and expands the degree of skew that can be safely corrected. For example, testing indicates that 40 mm of skew can be corrected in paper sheets as light as 45 gsm using the new technique compared to 4 mm for a straight sheet.

This and other examples described below and shown in the figures illustrate but do not limit the scope of the patent, which is defined in the Claims following this Description.

As used in this document "and/or" means one or more of the connected things and "side" means the top or bottom of a sheet when referring to a media sheet.

FIGS. 1 and 2 illustrate one example of a new sheet media alignment system 10. Referring to FIGS. 1 and 2, system 10 includes a guide 12 defining a curved media path 14 and a blocker 16 positioned along the downstream part of guide 12 to block a leading edge 18 of a media sheet 20 as it leaves guide 12. In this example, guide 12 is implemented as a deflector that deflects sheet 20 into the desired shape along media path 14. Deflector 12 constrains the top side 22 of sheet 20 along path 14. System 10 also includes a driver 24 upstream from deflector 12 to drive sheet 20 into deflector 12 along curved media path 14 and into blocker 16. In this example, driver 24 is implemented as a group of drive rollers positioned laterally across the media path to distribute the driving force uniformly across the width of sheet 20.

The group of drive rollers 24 is spaced from the upstream part of guide 12 a distance sufficient to enable sheet 20 to buckle between rollers 24 and guide 12 as leading edge 18 is driven into blocker 16, as shown in FIG. 2. In any case, the space between rollers 24 and guide 12 should be larger than the space between blocker 16 and guide 12 so that sheet 20 will buckle upstream from guide 12 before it will buckle downstream from guide 12.

The desired spacing may vary depending on the stiffness of the media sheets and the characteristics of the curved media path. For 45 gsm-90 gsm paper, for example, testing indicates a circular media path with a central angle $\theta$ of at least 45° and a radius R less than 200 mm should be adequate to achieve sufficient strength in each sheet 20 to absorb the shock of hitting the blocker and withstand the driving forces without damaging the sheet. (Radius R is called out in FIG. 8 and central angle $\theta$ is called out in FIG. 9.) Although it is expected that usually it will be desirable to position blocker 16 as close as possible to guide 12, to reduce the risk of buckling or damage at the leading edge 18 of a sheet 20, blocker 16 may be positioned further from the downstream part of guide 12 for stiffer sheets 20. For 45 gsm paper sheets 20, for example, a blocker positioned a distance D1 less than 4 mm from the downstream part of guide 12 and drive rollers 24 positioned a distance D2 at least 50 mm from the upstream part of guide 20 should be adequate to achieve the desired buckling without damaging the sheet. (Distances D1 and D2 are called out in FIG. 8.) For 90 gsm paper sheets 20, for another example, a blocker positioned less than 2 mm from the downstream part of guide 12 and drive rollers 24 positioned at least 70 mm from the upstream part of guide 20 should be adequate to achieve the desired buckling without damaging the sheet.

FIGS. 3-5 present a sequence of plan views showing an example alignment operation using a system 10 shown in FIGS. 1 and 2. Guide 12 and blocker 16 are depicted with phantom lines to more clearly show sheet 20. In FIG. 3, the leading edge 18 of sheet 20 is skewed (misaligned) to the line of advance, indicated by arrow 26. Rollers 24 are driving sheet 20 into guide 12 and the leading part of sheet 20 is bending down along the curved paper path. In FIG. 4, sheet 20 is "deskewed" as rollers 24 drive the leading edge 18 of sheet 20 into blocker 16 until, in FIG. 5, a buckle 28 forms in sheet 20 between rollers 24 and guide 12. Buckle 28 signals the end of the alignment operation, when blocker 16 is removed to allow the now aligned sheet 20 to advance.

FIG. 6 illustrates an example printer implementation for a sheet media alignment system such as the one shown in FIGS. 1 and 2. Referring to FIG. 6, in this example an LEP printer 30 includes a scorotron or other suitable charging device 32 to apply a uniform electric charge to a photoconductor 34, the photosensitive outer surface of a cylindrical drum for example. A scanning laser or other suitable photoimaging device 36 exposes select areas on photoconductor 34 to light 38 in a pattern corresponding to the desired ink image. A thin layer of LEP ink is applied to the patterned photoconductor 34 using a developer 40. Developer 40 represents a usually complex unit that supplies ink to photoconductor 34, for example through a series of rollers that rotate against the surface of the photoconductor. The ink from developer 40 adheres to the latent electrostatic image on photoconductor 34 to "develop" a liquid ink image on the photoconductor.

The liquid ink image is transferred from photoconductor 34 to an intermediate transfer member (ITM) 42 and then from ITM 42 to a media sheet 20 as it passes between ITM 42 and an impression cylinder 44. For some LEP printing processes, the images for each color plane are applied sequentially to a sheet 20 that goes around and around on cylinder 44 until all of the color plane images are transferred to the sheet. A lamp or other suitable discharging device 46 removes residual charge from photoconductor 34 and ink residue is removed at a cleaning station 48 in preparation for developing the next ink image.

Printer 30 also includes a media transport system 50 that includes a sheet alignment system 12 and a rotary sheet transfer mechanism 52 to transfer sheets from alignment system 12 to impression cylinder 44. In this example, transfer mechanism 52 is configured with a gripper 54 at the end of an arm 56. Alignment system 12 includes a drive roller 24 that rotates against an idler roller 58 to apply a driving force to sheet 20, and a guide 12 that defines a curved media path 14. The end of rotary arm 56 forms the blocker 16 in sheet alignment system 12. In this example, guide 12 is configured as a channel to constrain both the top side 22 and bottom side 60 of sheet 20 along path 14. Although the height of the media path through a channel 12 may vary depending on the thickness of media sheet 20, a channel 2 m to 6 mm will pass paper sheets up to 600 gsm with sufficient constraint to enable the desired deskew without additional risk of damage to the sheet.

Figure 7:
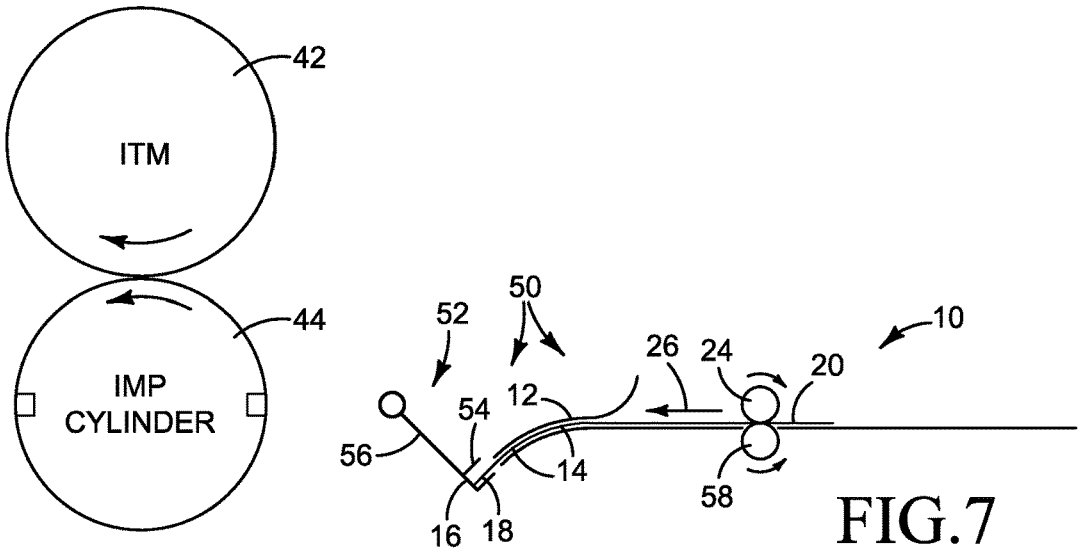
Figure 8:
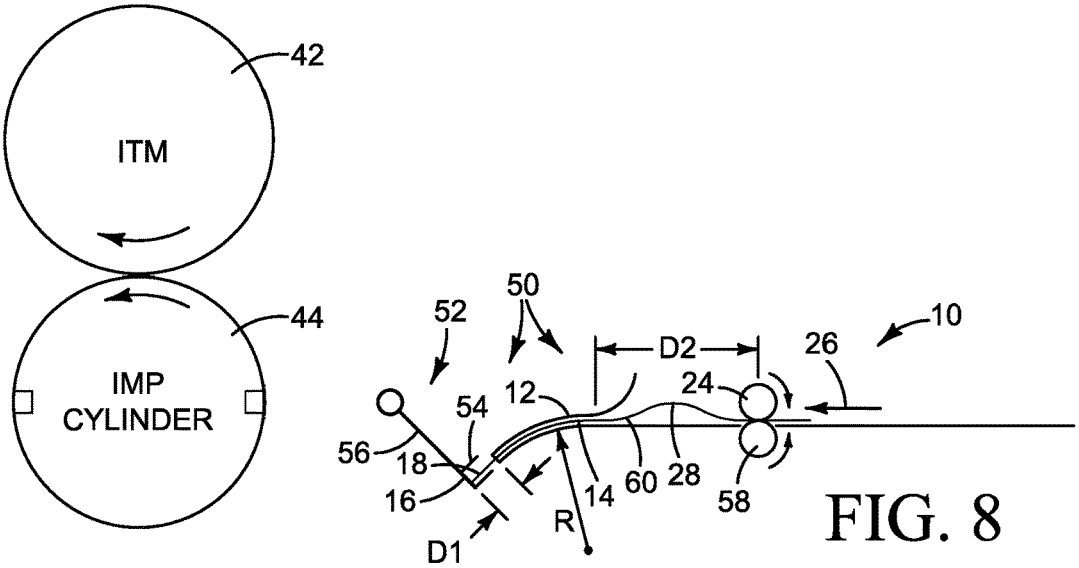
Figure 9:
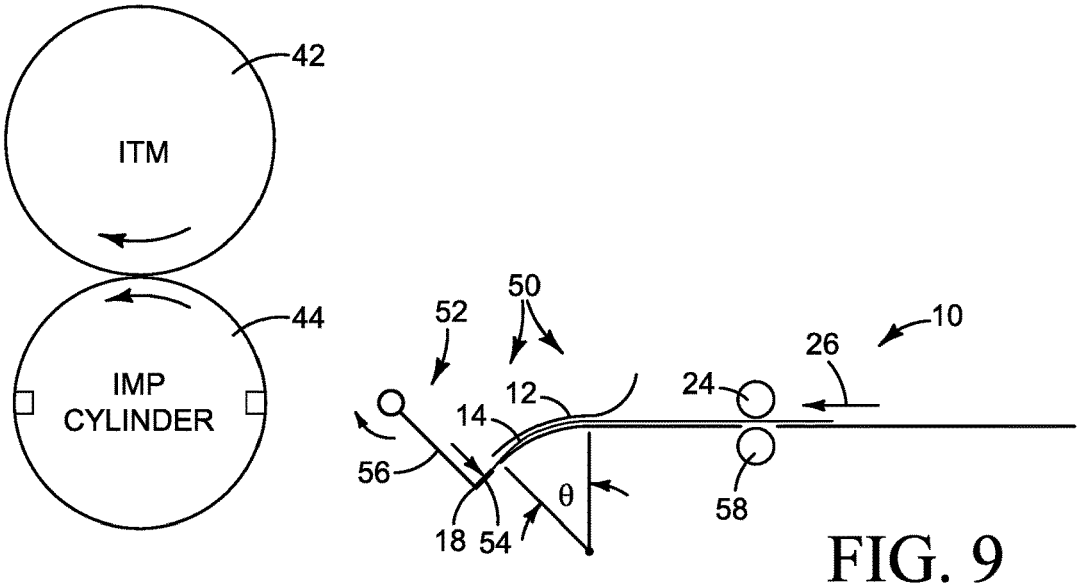
Figure 10:
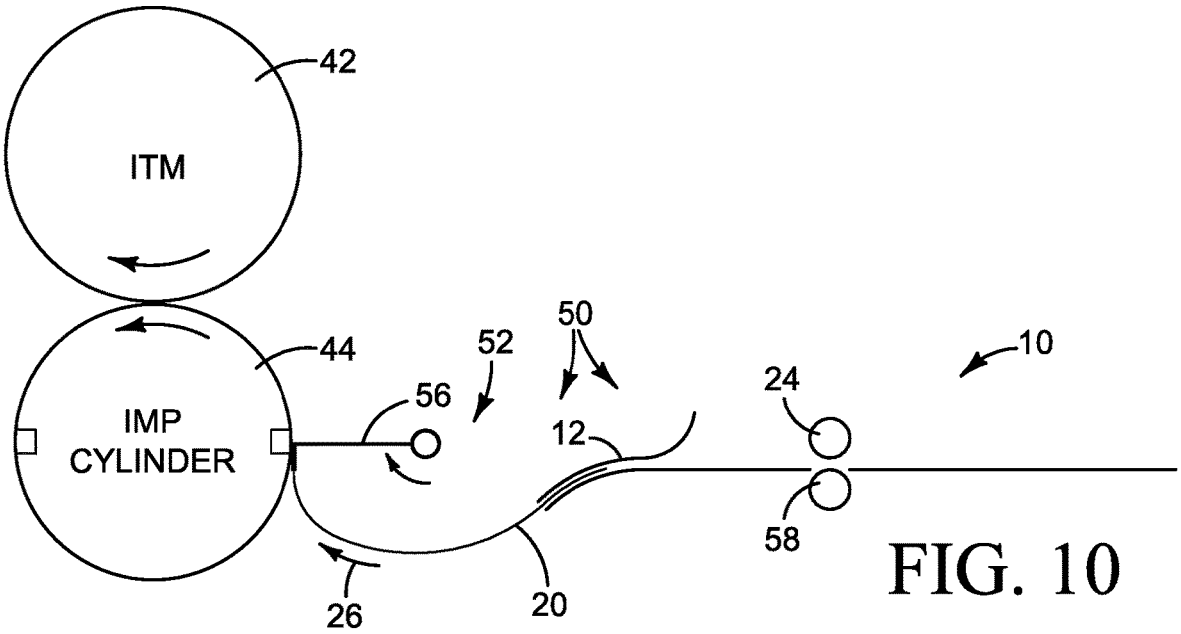
Figure 11:
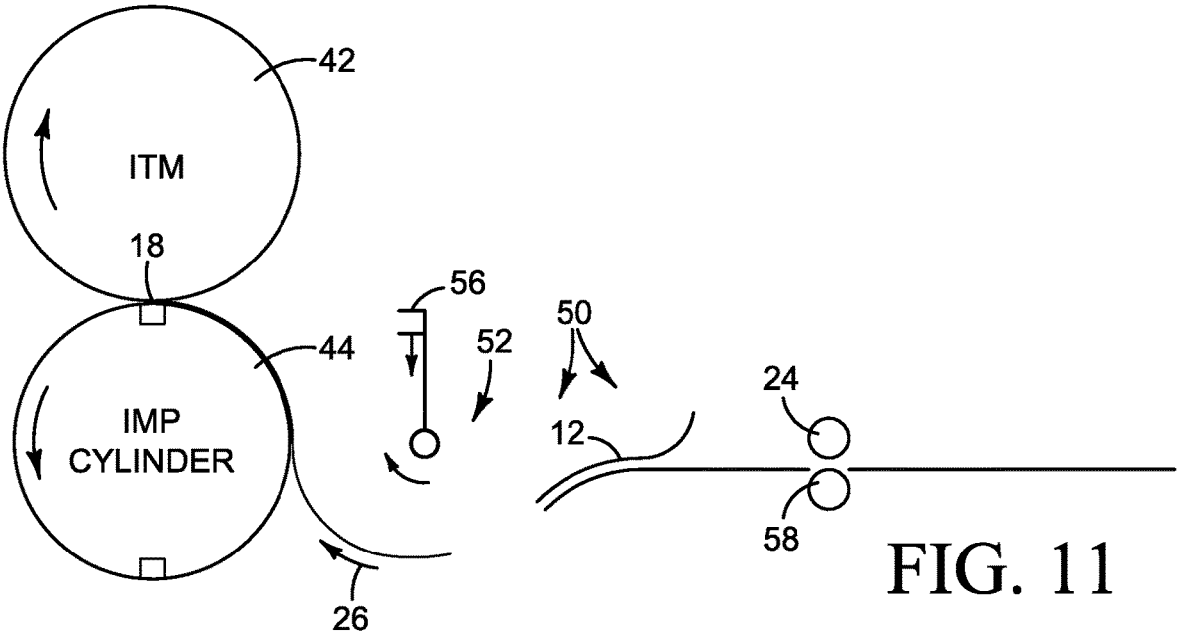

FIGS. 7-11 present a sequence showing the operation of the example alignment system 12 shown in FIG. 6. In FIG. 7, drive roller 24 is driving the leading edge 18 of sheet 20 into blocker 16 until, in FIG. 8, a buckle 28 forms in sheet 20 between rollers 24 and guide 12. Buckle 28 signals the end of the alignment operation and, as shown in FIG. 9, drive roller 24 is disengaged from sheet 20 as gripper 54 grips the leading edge 18 of sheet 20 and arm 56 is rotated to transfer the sheet to impression cylinder 44. As shown in FIGS. 10 and 11, arm 56 rotates gripper 54 along impression cylinder 44 to complete the transfer of sheet 20 from alignment system 12 to cylinder 44. The operation may then begin again for the next sheet after the ink image has been fully applied to sheet 20 at the nip between transfer member 42 and impression cylinder 44.

The examples shown in the figures and described above illustrate but do not limit the patent, which is defined in the following Claims.

"A", "an" and "the" used in the claims means at least one.

The invention claimed is:

1. A sheet media alignment system, comprising:

a guide defining a curved media path that extends from an upstream part of the guide to a downstream part of the guide;

a movable blocker to block the curved media path at the downstream part of the guide, the blocker movable into and out of a blocking position in which the blocker is spaced from the downstream part of the guide a first distance;

a gripper to releasably grip a leading edge of a media sheet near the downstream part of the guide;

a rotary arm to rotate the gripper away from the guide while gripping the leading edge of the media sheet; and a driver upstream from the curved media path to drive the leading edge of the media sheet into the guide along the curved media path and into the blocker and the gripper, the driver spaced from the upstream part of the guide a second distance greater than the first distance such that a media sheet driven into the blocker will buckle between the driver and the guide before it will buckle between the guide and the blocker.

2. The system of claim 1, where the curved media path has a central angle of at least 45°.

3. The system of claim 2, where the curved media path is circular with a radius less than 200 mm.

4. The system of claim 3, where the first distance is less than 4 mm and the second distance is at least 50 mm.

5. The system of claim 1, where the guide comprises a channel to constrain both sides of the media sheet along the curved media path through the channel.

6. The system of claim 5, where the curved media path through the channel is 2 mm to 6 mm high.

7. The system of claim 1, where the guide comprises a deflector to constrain a top side of the media sheet along the curved media path.

8. A sheet media alignment system, comprising:

a guide defining a curved media path;

a transfer mechanism to move a media sheet away from the guide, the transfer mechanism including a blocker movable into a blocking position to block a leading edge of the media sheet exiting the guide and away from the blocking position to allow moving the media sheet away from the guide; and a drive roller upstream from the curved media path to drive a media sheet into the guide along the curved media path and to drive the leading edge of the sheet into the blocker;

the blocker positioned less than 4 mm from an exit from the guide when the blocker is in a blocking position; and the drive roller positioned at least 50 mm from an entrance to the guide.

9. The system of claim 8, where the curved media path has a central angle of at least 45°.

10. The system of claim 9, where the curved media path is circular with a radius less than 200 mm.

11. A sheet media alignment system, comprising:

a channel defining a curved media path that extends from an upstream part of the channel to a downstream part of the channel;

a transfer mechanism to move a media sheet away from the downstream part of the channel, the transfer mechanism movable into a stationary blocking position to block a leading edge of the media sheet leaving the channel and away from the stationary blocking position to move the media sheet out of the channel; and a drive roller upstream from the channel to drive the leading edge of the media sheet into the transfer mechanism when the transfer mechanism is in the stationary blocking position.

12. The system of claim 11, where the transfer mechanism includes a gripper to releasably grip the leading edge of the media sheet, the gripper blocking the leading edge of the media sheet leaving the channel when the transfer mechanism is in a blocking position and the gripper gripping the leading edge of the media sheet when the transfer mechanism is moving away from the stationary blocking position.

13. The system of claim 12, where the transfer mechanism comprises a rotary arm to rotate the gripper into and away from a blocking position.

14. The system of claim 13, where:

the gripper is spaced from the downstream part of the channel a first distance when the transfer mechanism is in a stationary blocking position; and the drive roller is spaced from the upstream part of the channel a second distance greater than the first distance such that the media sheet driven into the stationary gripper will buckle between the drive roller and the channel before it will buckle between the channel and the gripper.

15. The system of claim 14, where:

the curved media path has a central angle of at least 45°;

the first distance is less than 4 mm; and the second distance is at least 50 mm.

* * * * *